US010488020B2

(12) United States Patent
Zanotto et al.

(10) Patent No.: US 10,488,020 B2
(45) Date of Patent: Nov. 26, 2019

(54) END CAP FOR LIGHTING DEVICES, CORRESPONDING METHOD AND DEVICE

(71) Applicant: OSRAM GmbH, Munich (DE)

(72) Inventors: Alberto Zanotto, Padua (IT); Simon Bobbo, Mirano (IT); Aleksandar Nastov, Munich (DE); Roberto Didone', Rosà (IT); Lorenzo Baldo, Giavera del Montello (IT)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 15/708,212

(22) Filed: Sep. 19, 2017

(65) Prior Publication Data

US 2018/0080635 A1 Mar. 22, 2018

(30) Foreign Application Priority Data

Sep. 20, 2016 (IT) ..... 102016000094478

(51) Int. Cl.

| | |
|---|---|
| ***F21V 15/015*** | (2006.01) |
| ***F21K 9/272*** | (2016.01) |
| ***F21V 21/005*** | (2006.01) |
| ***F21V 31/00*** | (2006.01) |
| ***F21V 21/02*** | (2006.01) |
| *F21Y 103/10* | (2016.01) |

(52) U.S. Cl.

CPC ..... *F21V 15/015* (2013.01); *F21K 9/272* (2016.08); *F21V 21/005* (2013.01); *F21V 21/025* (2013.01); *F21V 31/005* (2013.01); *F21Y 2103/10* (2016.08)

(58) Field of Classification Search

CPC ..... F21V 5/015; F21V 21/005; F21V 21/025; F21V 31/005; F21K 9/272; F21Y 2103/10

See application file for complete search history.

(56) References Cited

U.S. PATENT DOCUMENTS

| | | | | |
|---|---|---|---|---|
| 2,264,141 | A * | 11/1941 | Nemeroff | F21S 8/06 362/224 |
| 2010/0002426 | A1 | 1/2010 | Wu et al. | |
| 2010/0201239 | A1* | 8/2010 | Mostoller | F21S 8/031 313/1 |
| 2011/0156591 | A1* | 6/2011 | Lin | F21V 15/01 315/113 |

(Continued)

FOREIGN PATENT DOCUMENTS

| | | | |
|---|---|---|---|
| DE | 102012204654 | A1 | 9/2013 |
| EP | 2581652 | A1 | 4/2013 |
| WO | 2012098480 | A1 | 7/2012 |

OTHER PUBLICATIONS

Italian Search Report based on application No. 201600094478 (6 pages) dated Mar. 30, 2017 (Reference Purpose Only).

*Primary Examiner* — Y M. Lee

(74) *Attorney, Agent, or Firm* — Viering Jentschura & Partner MBB

(57) ABSTRACT

An end cap for elongate lighting modules having an exposed end surface and a front light emitting surface may include a body wall which may be brought into abutment against said end surface, and a peripheral wall extending sidewise of and around the body wall, the peripheral wall having a discontinuity therein positionable at the front light emitting surface. The body wall may include at least one sealing mass reception cavity facing towards the peripheral wall.

8 Claims, 2 Drawing Sheets

(56) References Cited

U.S. PATENT DOCUMENTS

| | | | | |
|---|---|---|---|---|
| 2012/0243217 | A1* | 9/2012 | Szprengiel | F21S 8/043<br>362/223 |
| 2014/0036491 | A1* | 2/2014 | Su | F21V 19/0085<br>362/217.17 |
| 2014/0043802 | A1* | 2/2014 | Dings | F21S 2/005<br>362/221 |
| 2017/0268756 | A1* | 9/2017 | Chami | F21V 21/005 |

* cited by examiner

END CAP FOR LIGHTING DEVICES, CORRESPONDING METHOD AND DEVICE

CROSS-REFERENCE TO RELATED APPLICATION

This application claims priority to Italian Patent Application Serial No. 102016000094478, which was filed Sep. 20, 2016, and is incorporated herein by reference in its entirety.

TECHNICAL FIELD

Various embodiments generally relate to lighting devices.

One or more embodiments may find application in lighting devices employing electrically-powered light radiation sources, e.g. solid-state light radiation sources such as LED sources.

One or more embodiments may find employment in the lighting devices having a protection against the penetration of foreign agents.

BACKGROUND

One of the advantages offered by elongate (e.g. ribbon-shaped and flexible) lighting modules employing LED light radiation sources is the possibility of cutting said modules to length according to the application and usage needs.

If the module is protected against the penetration of foreign agents (e.g. if it is provided with an IP degree protection), the cut may lead to the presence of an exposed end, which may lose the protection degree against foreign agents, therefore bringing about the undesired penetration of water, condensate, various particles from the outside.

In order to face this problem, the use of end caps has been proposed which are adapted to be applied on the exposed ends, e.g. after applying a sealing material.

Different materials may be used for said end caps, such as various plastic materials, rubbers, silicone materials, resins such as polymethylmethacrylate (PMMA), polycarbonate (PC), etc. For example, a silicone rubber may be employed as a sealing material.

The use of said caps, adapted to be applied after cutting the module to length, may however originate various disadvantages.

A considerable drawback may consist in the final portion of the light radiation emitting area being covered by the end cap, which may originate optical defects in the final application. This drawback may be particularly evident if said solution is used for two lighting modules arranged with mutually facing terminal ends.

SUMMARY

One or more embodiments aim at overcoming the previously outlined drawbacks.

One or more embodiments relate to an end cap.

One or more embodiments may also concern a corresponding method, as well as a corresponding lighting device.

One or more embodiments may lead to the achievement of an IP degree protection in one or more modules, e.g. LED modules, without originating undesired alterations of the emission features of the light radiation, as regards both the light emitting surface and the distribution and quality of the emitted light radiation.

One or more embodiments may be applied to lighting modules, e.g. LED modules, having various shapes, e.g. with rectangular, square, circular or other cross-section.

One or more embodiments may offer one or more of the following advantages:

- the IP degree protection may be achieved while avoiding the presence of walls shielding the light radiation emitting area at the cut ends;
- the IP degree protection may be achieved in a plurality of modules by employing one accessory ("twofold" end cap), while reducing the overall size of the protection system,
- optical deviations are virtually absent in the application,
- a continuous light radiation emitting surface may be obtained between two adjoining modules arranged one after the other, e.g. by using a light-diffusive material for the end cap.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
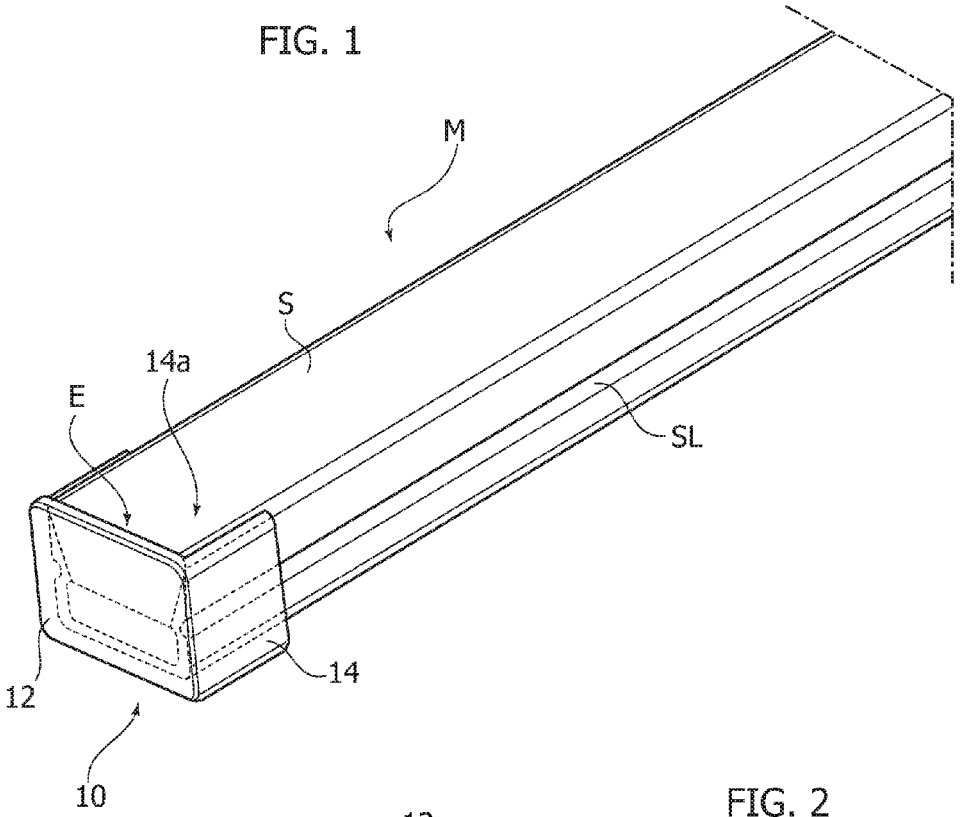
FIG. 1 exemplifies possible usages of embodiments.

In the following description, various specific details are given to provide a thorough understanding of various exemplary embodiments. The embodiments may be practiced without one or several specific details, or with other methods, components, materials, etc. In other instances, well-known structures, materials or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or scope of the embodiments.

In the Figures, references M (FIG. 1) and M1, M2 (FIGS. 3 and 4) denote lighting devices (modules) of an elongate (optionally ribbon-like and/or flexible) shape, adapted to employ electrically-powered light radiation sources, e.g. solid-state light radiation sources such as LED sources.

Such modules may include, for example, a channel-shaped casing, which hosts a support substantially similar to a Printed Circuit Board (PCB), whereon there are arranged light radiation sources, e.g. LED sources. A cover, which may include e.g. a sealing material, is adapted to impart protection features against the penetration of foreign agents (e.g. an IP degree protection) to module M, M1, M2.

Such lighting devices (modules) are known in the art, which makes it unnecessary to provide a more detailed description herein.

As far as relevant hereto, it will be sufficient to mention that said modules M, M1, M2 (adapted to have any shape or size, e.g. with rectangular cross-section, as in the presently discussed examples, or with square, polygonal, circular or other sections) may have a surface S, e.g. a front surface, wherefrom the light radiation is emitted.

Such modules M, M1, M2 may be considered as having an indefinite length, and are adapted to be cut to length according to application and usage needs. This originates exposed end surfaces (which normally extend in a transversal plane with respect to the lengthwise extension of the module), such as the surfaces denoted as E in FIG. 2 and as E1, E2 in FIG. 4, wherein two such surfaces are shown as mutually facing.

As mentioned in the introduction to the present description, a cutting operation may eliminate the protection features of the module against the penetration of foreign agents (water, condensate, particles) in the area of such end surfaces E, E1, E2.

One or more embodiments may lead to the achievement of a desired protection degree also at such end surfaces E, E1, E2, which are exposed due to cutting.

Figure 2:
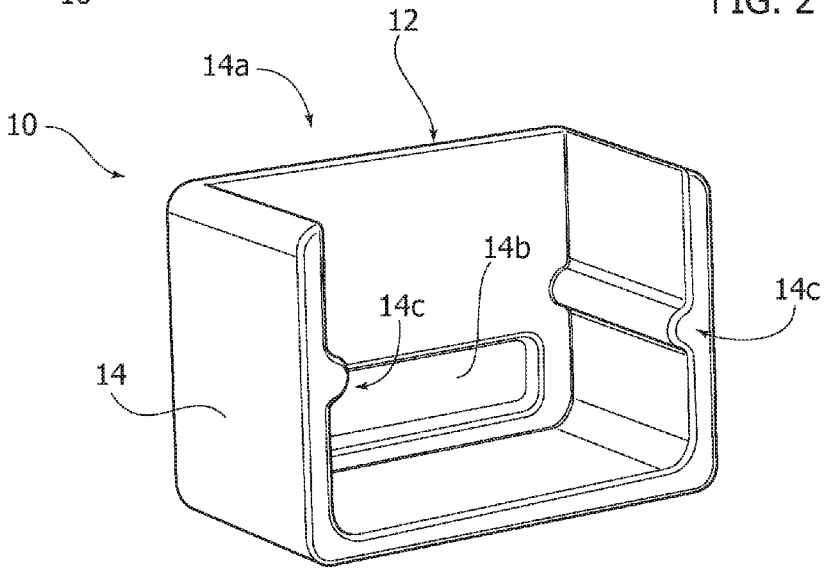
FIG. 2 is a perspective view of an end cap according to embodiments, shown in a magnified view with respect to FIG. 1, and FIGS. 3 and 4 exemplify possible usages of embodiments.
Figure 3:
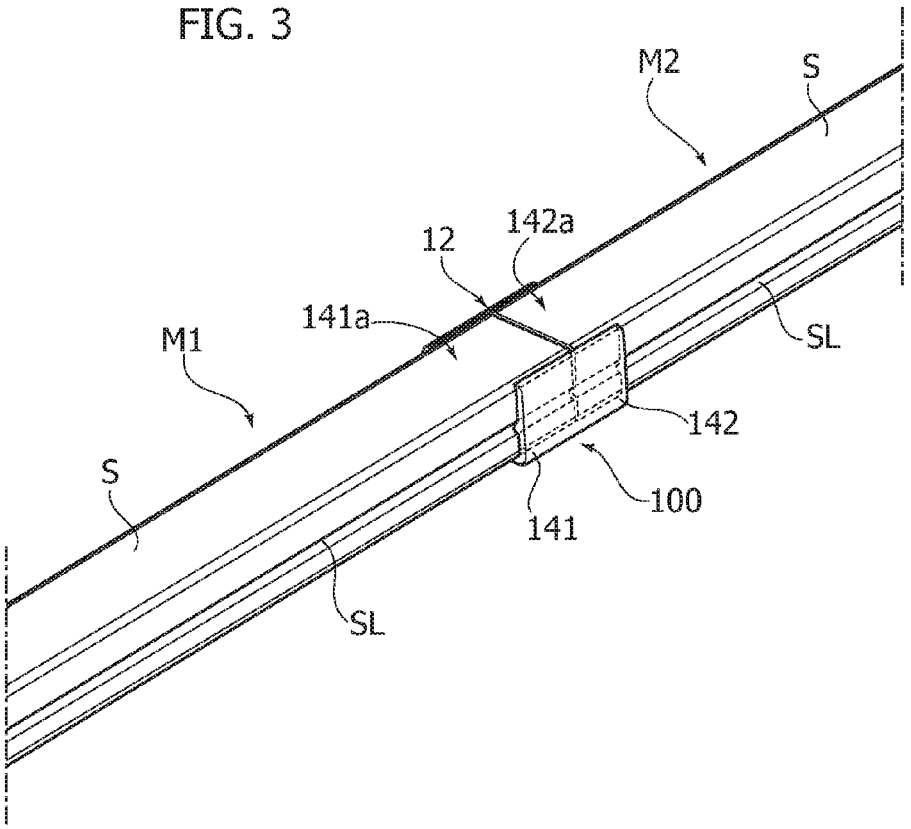
Figure 4:
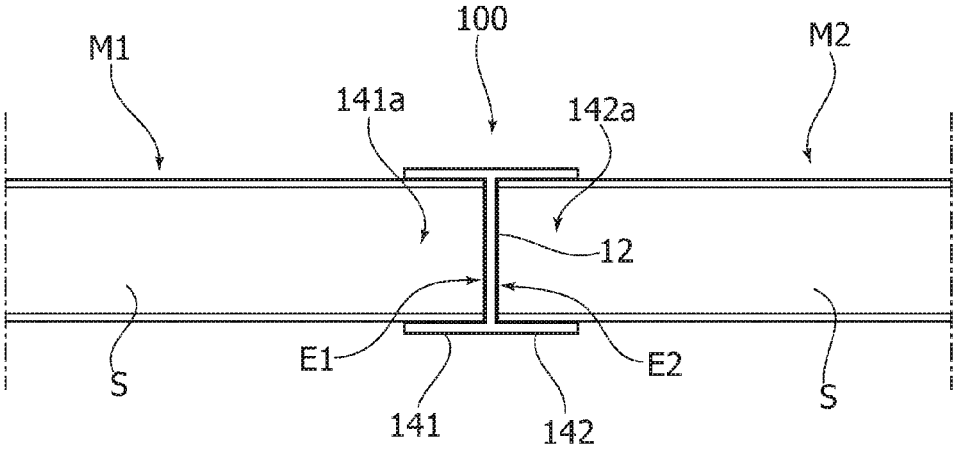

To this end, one or more embodiments may envisage an end cap adapted to be configured:

- as a "single" cap, denoted as 10 in FIGS. 1 and 2, adapted to be used with one module M,
- as a "twofold" or "two-faced" cap, denoted as 100 in FIGS. 3 and 4, adapted to be used with two adjoining modules M1, M2 (which abut against each other).

As can be seen in FIG. 2, a single cap 10 may include a body adapted to be defined as bowl-shaped, which is exemplified herein as having a rectangular cross-section, but which may have any cross-section complementary to the cross-section of modules M, M1, M2 (therefore, for instance, a square, polygonal, circular or other shape); from this bowl-shaped body a portion of the side wall has been so to say ideally removed.

In one or more embodiments, a cap 10 as exemplified in FIGS. 1 and 2 may therefore comprise a body wall (bottom wall) 12, adapted to be brought into abutment against the end surface E obtained through the cutting of module M, and a peripheral wall 14 having a gap or discontinuity 14*a*, adapted to be arranged at the front light emitting surface S, as exemplified in FIG. 1.

In one or more embodiments, it is therefore possible to bring body wall 12 of cap 10 in abutment against end surface E, while side wall 14 extends around the end of module M without interfering (or interfering only marginally) with the front light emitting surface S.

In one or more embodiments, the gap or discontinuity 14*a* may be sized so as to have a width corresponding (i.e. approximately equal) to the width of light radiation emitting surface S of module M.

In one or more embodiments, the sealing (and therefore the protecting) action at end surface E may involve applying a sealing mass, e.g. a silicone glue.

In one or more embodiments, bottom wall 12 may have, on the region facing side wall 14, a cavity 14*b* adapted to act as a sealing mass reception cavity.

In one or more embodiments, side wall 14 may have, on the side facing the interior of cap 10, one or more sculpturings (e.g. ribs 14*c*) adapted to engage complementary formations (e.g. grooves SL) provided on the flanks of module M, e.g. according to the criteria described in an Italian Patent Application for Invention filed on the same date by the same Applicants.

In one or more embodiments, as visible in FIG. 2, cavity 14*b* may be arranged in a position opposite discontinuity 14*a*, i.e. in the portion of bottom wall 12 nearest the portion of peripheral wall 14 opposite discontinuity 14*a*.

For example, with the sculpturing 14*c* extending approximately halfway the respective portions of side wall 14, so as to (ideally) halve the bottom wall, cavity 14*b* may be arranged in the half of bottom wall 12 opposite discontinuity 14*a*, i.e. in the half of bottom wall 12 nearest the portion of peripheral wall 12 opposite discontinuity 14*a*.

In this way it is possible to counter the migration of the sealing mass dispensed into cavity 14*b* towards discontinuity 14*a*, preventing it from overflowing or smearing onto front surface S of module M, e.g. because it is present in an excessive amount.

What previously stated may apply in the same way to the twofold cap 100 exemplified in FIGS. 3 and 4.

For example, in one or more embodiments, cap 100 may have two side walls 141, 142 extending in opposite directions with respect to body wall 12, each of the side walls 141, 142 having a gap or discontinuity 141*a*, 142*a* adapted to be positioned at the light radiation emitting surfaces S of both modules M1, M2, so as to act simultaneously as end sealing cap for both modules M1, M2 between which it is set.

In one or more embodiments, bottom wall 12 of cap 100 may be provided, on the opposite surfaces thereof, with cavities adapted to receive a respective mass of sealing material, as in the case of cavity 14*b* shown in FIG. 2 with reference to the "single" cap 10.

FIGS. 3 and 4 exemplify solutions wherein the gaps or discontinuities 141*a*, 142*a* are oriented in the same direction, for the coupling to two modules M1, M2 arranged with their light radiation emitting surfaces S oriented in turn in the same direction.

In one or more embodiments, cap 100 may however be implemented with the gaps or discontinuities 141*a*, 142*a* oriented in different directions, so as to enable a use with modules M1, M2 having their surfaces S with a correspondingly different orientation (e.g. 90° or 180° one to the other).

As regards the possibility of using two single caps 10 mounted in opposite directions, a cap 100 according to one or more embodiments as exemplified in FIGS. 3 and 4 offers the advantage of decreasing the thickness of the material corresponding to the body wall 12 which is to be sandwiched between the two mutually facing ends E1, E2 of modules M1, M2. In this way, the overall optical effect may be improved, because the thickness of the dark area interposed between both modules is correspondingly reduced.

As regards the choice of the materials which may be used for caps 10, 100, one or more embodiments may envisage the use of plastic materials or rubbers, e.g. as exemplified in the introductory section to the present description.

One or more embodiments may envisage the use of a light-permeable material (e.g. a transparent material), having e.g. light-diffusing properties; this may be for example a silicone material embedding light-diffusive particles, such as alumina particles.

In one or more embodiments, cap 10 may comprise two different materials, e.g. a light-diffusive material and a perfectly transparent material; the latter material is used at discontinuity 14*a*, which therefore may include, instead of a "physical" discontinuity (i.e. a gap), a discontinuity in the features of light propagation across the material of side wall 14 (i.e., for example, a transition from a diffusive-milky white material to a perfectly transparent material, the latter being positionable at the front light emitting surface of the associated module(s)).

In one or more embodiments cap 10, 100 may also act as a waveguide, being adapted to be lighted up when modules M, M1, M2 are activated, eliminating therefore the possible presence of dark areas at the ends of the module(s).

One or more embodiments may therefore relate to an end cap (e.g. 10 or 100) for elongate lighting modules (e.g. M or M1, M2) having an exposed end surface (e.g. E or E1, E2) and a front light emitting surface (e.g. S), wherein the end cap may include:

a body wall (e.g. 12) to be brought into abutment against said end surface, and at least one peripheral wall (e.g. 14 or 141, 142) extending sidewise of said body wall and around said body wall, the at least one peripheral wall having at least one discontinuity (e.g. 14*a* or 141*a*, 142*a*) positionable at said front light emitting surface.

In one or more embodiments, said body wall may comprise at least one sealing mass reception cavity (e.g. 14*b*) facing towards said at least one peripheral wall.

One or more embodiments may include said at least one sealing mass reception cavity in said body wall located opposite said at least one discontinuity in the at least one peripheral wall.

One or more embodiments may include light-permeable material and/or light-diffusive material.

In one or more embodiments which may be employed with a pair of said lighting modules (e.g. M1, M2) arranged with mutually facing exposed end surfaces (e.g. E1, E2), an end cap (e.g. 100) may include a pair of said peripheral walls (e.g. 141, 142) extending in opposite directions sidewise of said body wall, each of said peripheral walls extending around said body wall and having at least one discontinuity (e.g. 141*a*, 142*a*) positionable at the front light emitting surface of one of said lighting modules.

In one or more embodiments, said body wall may include opposite surfaces including at least one sealing mass reception cavity facing one of said peripheral walls.

In one or more embodiments, a method of providing an end sealing of at least one lighting module having an exposed end surface and a front light emitting surface may include:

providing an end cap according to one or more embodiments, coupling said end cap with said exposed end surface by bringing said body wall in abutment against said exposed end surface, with said at least one peripheral wall extending around said exposed end surface, and said at least one discontinuity positioned at said front light emitting surface.

In one or more embodiments, said method may include:

arranging a pair of said elongate lighting modules (having front light emitting surfaces) with mutually facing respective exposed end surfaces, arranging an end cap according to one or more embodiments between the modules of said pair of lighting modules, by bringing said body wall into abutment against said mutually facing exposed end surfaces, and with said peripheral walls extending around said end surfaces.

One or more embodiments may envisage dispensing sealing material between said body wall of the end cap and the exposed end surface or surfaces against which said body wall is brought into abutment.

In one or more embodiments, a lighting device may include:

at least one lighting module having an exposed end surface and a front light emitting surface, and an end cap according to one or more embodiments arranged with said body wall in abutment against said exposed end surface and said at least one peripheral wall extending around said exposed end surface, with said discontinuity positioned at said front light emitting surface.

A device according to one or more embodiments may include:

a pair of said elongate lighting modules (having front light emitting surfaces) arranged with mutually facing, respective exposed end surfaces, an end cap according to one or more embodiments, set between the modules of said pair of lighting modules, with said body wall abutting against said mutually facing exposed end surfaces and said peripheral walls of the end cap extending around said end surfaces.

A device according to one or more embodiments may include sealing material between said body wall of the end cap and the exposed end surface or surfaces against which said body wall abuts.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An end cap for elongate lighting modules having an exposed end surface and a front light emitting surface for use with a pair of said elongate lighting modules arranged with mutually facing exposed end surfaces, comprising:

a body wall for abutment against said end surface, and a pair of peripheral walls extending in opposite directions sidewise of said body wall and around said body wall, each peripheral wall of the pair of peripheral walls having at least one exposed discontinuity therein positionable at said front light emitting surface of one of said lighting modules;

wherein light from the front light emitting surface is configured to be emitted through the at least one exposed discontinuity of the end cap.

2. The end cap of claim 1, wherein said body wall includes at least one sealing mass reception cavity facing towards the pair of peripheral walls.

3. The end cap of claim 2, wherein said at least one sealing mass reception cavity in said body wall is located opposite said at least one discontinuity in the pair of peripheral walls.

4. The end cap of claim 1, further comprising light-permeable material and/or light-diffusive material.

5. The end cap of claim 1, wherein said body wall includes opposite surfaces including a sealing mass reception cavity facing at least one of said peripheral walls.

6. A method of providing end sealing for an elongate lighting module having an exposed end surface and a front light emitting surface, the method comprising:

providing an end cap, the end cap comprising a body wall for abutment against said end surface, and a pair of peripheral walls extending in opposite directions sidewise of said body wall where each peripheral wall of the pair of peripheral walls extends around said body wall, wherein each peripheral wall of the pair of peripheral walls has at least one discontinuity therein positionable at said front light emitting surface; wherein the body wall includes opposite surfaces that each include a sealing mass reception cavity facing towards the pair of peripheral walls; wherein the at least one sealing mass reception cavity is arranged in a portion of the body wall opposite to the at least one discontinuity in each peripheral wall of the pair of peripheral walls, arranging the end cap between a pair of elongate lighting modules with mutually facing, respective exposed end surfaces where the body wall of the end cap abuts against the mutually facing exposed end surfaces with the pair of peripheral walls extending around the end surfaces; and dispensing sealing material between the body wall and the exposed end surfaces against which the body wall is abutted by dispensing the sealing material into the at least one sealing mass reception cavity in the body wall.

7. A lighting device, comprising:

a pair of elongate lighting modules arranged with mutually facing respective exposed end surfaces and a front light emitting surface, an end cap, the end cap comprising a body wall for abutment against said end surface, and a pair of peripheral walls extending in opposite directions sidewise of said body wall and around said body wall, each peripheral wall of the pair of peripheral walls having at least one exposed discontinuity therein positionable at said front light emitting surface of one of said lighting modules, the end cap arranged with said body wall in abutment against said exposed end surface and said at least one peripheral wall extending around said exposed end surface with said at least one discontinuity positioned at said front light emitting surface;

wherein light from the front light emitting surface is configured to be emitted through the at least one exposed discontinuity of the end cap.

8. The lighting device of claim 7, further comprising sealing material between said body wall of the end cap and the exposed end surface or surfaces against which said body wall abuts.

* * * * *